United States Patent [19]

Bush

[11] Patent Number: 5,066,188

[45] Date of Patent: Nov. 19, 1991

[54] APPARATUS FOR LOADING AND UNLOADING OPEN TOP RAILROAD CARS

[75] Inventor: David E. Bush, Rte. 1 Box 77, Gary, Tex. 75643

[73] Assignee: David E. Bush, Gary, Tex.

[21] Appl. No.: 525,978

[22] Filed: May 17, 1990

[51] Int. Cl.[5] ..... B65G 67/02

[52] U.S. Cl. ..... 414/339; 414/500; 414/537; 414/559; 414/394; 14/71.3

[58] Field of Search ..... 414/339, 394, 537, 538, 414/494, 500, 559, 571; 280/764; 104/137; 14/71.3

[56] References Cited

U.S. PATENT DOCUMENTS

| | | | |
|---|---|---|---|
| 1,567,478 | 12/1925 | Vonnez et al. | 414/500 |
| 2,823,818 | 2/1958 | Chastain et al. | 414/494 |
| 3,880,072 | 4/1975 | Ord | 414/494 X |
| 4,051,988 | 10/1977 | Massey | 414/559 X |
| 4,096,954 | 6/1978 | Buckner . | |
| 4,099,635 | 7/1978 | Leonard et al. . | |
| 4,109,810 | 8/1978 | Jones | 414/500 X |
| 4,128,180 | 12/1978 | Mellious . | |
| 4,175,902 | 11/1979 | Herzog et al. | 414/339 |
| 4,190,394 | 2/1980 | Herzog et al. . | |
| 4,241,811 | 12/1980 | Buckner | 104/137 X |
| 4,249,851 | 2/1981 | Sedelmayer | 414/559 X |
| 4,702,662 | 10/1987 | Marlett | 414/500 X |
| 4,723,886 | 2/1988 | Frederking . | |
| 4,746,261 | 5/1988 | Landoll et al. | 414/500 X |
| 4,830,562 | 5/1989 | Frederking . | |
| 4,930,799 | 6/1990 | Pihlström et al. | 414/494 X |

FOREIGN PATENT DOCUMENTS

| | | | |
|---|---|---|---|
| 2181715 | 4/1987 | United Kingdom | 414/494 |

*Primary Examiner*—Robert J. Spar
*Assistant Examiner*—James Keenan

[57] ABSTRACT

An apparatus for loading and unloading open top railroad cars (46) utilizing a conventional material handling equipment item attached to a slidable structure (20). The material handling equipment item is equipped with a boom structure (64) and material handling device (66). During railcar loading and unloading operations, the operator positions and attaches the material handling equipment item onto the slidable structure (20) which is positioned adjacent to an end of the railcar (46). The front of the structure is engaged with the top surface of the railcar endwall (72) and the material handling device is positioned on the railroad bed (52) adjacent to the rear of the slidable structure (20). The boom structure (64) is then extended to position the apparatus atop the railcar (46). The apparatus (18) is then supported on the sidewall (76) upper surface of the railcar by support members (22) which are hydraulically extendable from the structure ends (36). The support members (22) are equipped with stabilizer dogs (40) which extend downwardly adjacent to the upper surface of the parallel sidewalls of the railcar for stability while loading and unloading material. The apparatus is moved forward or backward along the top of the railcar (46) by a hydraulic winch (30) mounted in the center of the slidable structure (20).

6 Claims, 5 Drawing Sheets

APPARATUS FOR LOADING AND UNLOADING OPEN TOP RAILROAD CARS

BACKGROUND OF THE INVENTION

1. Field of Invention

The present invention relates to an apparatus for loading and unloading open top railroad cars utilizing a conventional material handling equipment item attached to a slidable structure.

2. Description of the Prior Art

Open top railroad cars are widely used to transport a variety of cargoes. Heretofore, several methods are known for loading and unloading of these cargoes. Loading and unloading operations have been accomplished by mobile or stationary cranes positioned adjacent to the area of railroad cars.

However, it is quite common for loading or unloading operations to be conducted far from a depot, yard or other facility where cranes may be used. In such situations, material such as railroad ballast and cross-ties must be loaded or unloaded by manual labor or by methods employing specialized machinery.

The use of hand labor is normally costly and time consuming. However, a specifically designed loading or unloading machine requires a considerable capital expenditure.

U.S. Pat. No. 4,099,635 issued to Leonard, et al, 7/78, discloses a gondola car loader. The apparatus would be prohibitively expensive to manufacture. It could be used only for loading or unloading gondola cars. It would also require special lifting equipment to position the apparatus atop the railroad car.

U.S. Pat. Nos. 4,190,394, 2/80 and 4,175,902, 11/79 issued to Herzog, et al, discloses a method and an apparatus, respectively, for loading and unloading railroad cars utilizing a backhoe-loader with rubber tires. The apparatus positions the operator and controls in the center of the railcar. The apparatus is also limited to a 180 degree swing of the boom structure.

U.S. Pat. Nos. 4,830,562, 5/89 and 4,723,886, 2/88, issued to Frederking, discloses an apparatus for loading and unloading railroad gondola cars utilizing a modified hydraulic excavator. This apparatus requires extensive and expensive modification upon the hydraulic excavator undercarriage. It also requires the use of a ramp for mounting or dismounting the railcars.

OBJECTS AND ADVANTAGES

It is the object of the present invention to provide a safe and inexpensive apparatus for loading and unloading open top railroad cars. Several objects and advantages of the present invention are to provide an apparatus for loading and unloading open top railroad cars:

(a) by utilizing a conventional material handling equipment item which can be used for normal trenching and material handling duties when not loading or unloading railcars;

(b) without requiring the use of ramps or special lifting devices to place the apparatus into position atop the railroad cars;

(c) using a conventional material handling equipment item without modification; and (d) by having the operator move to the side of the railcar when the boom and the material handling device is rotated to the side of the railcar, where the operator has a better view of the adjacent work area.

Other objects and advantages will become apparent from consideration of the following description and drawings.

DRAWING FIGURES

REFERENCE NUMERALS IN DRAWINGS

Figure 1:
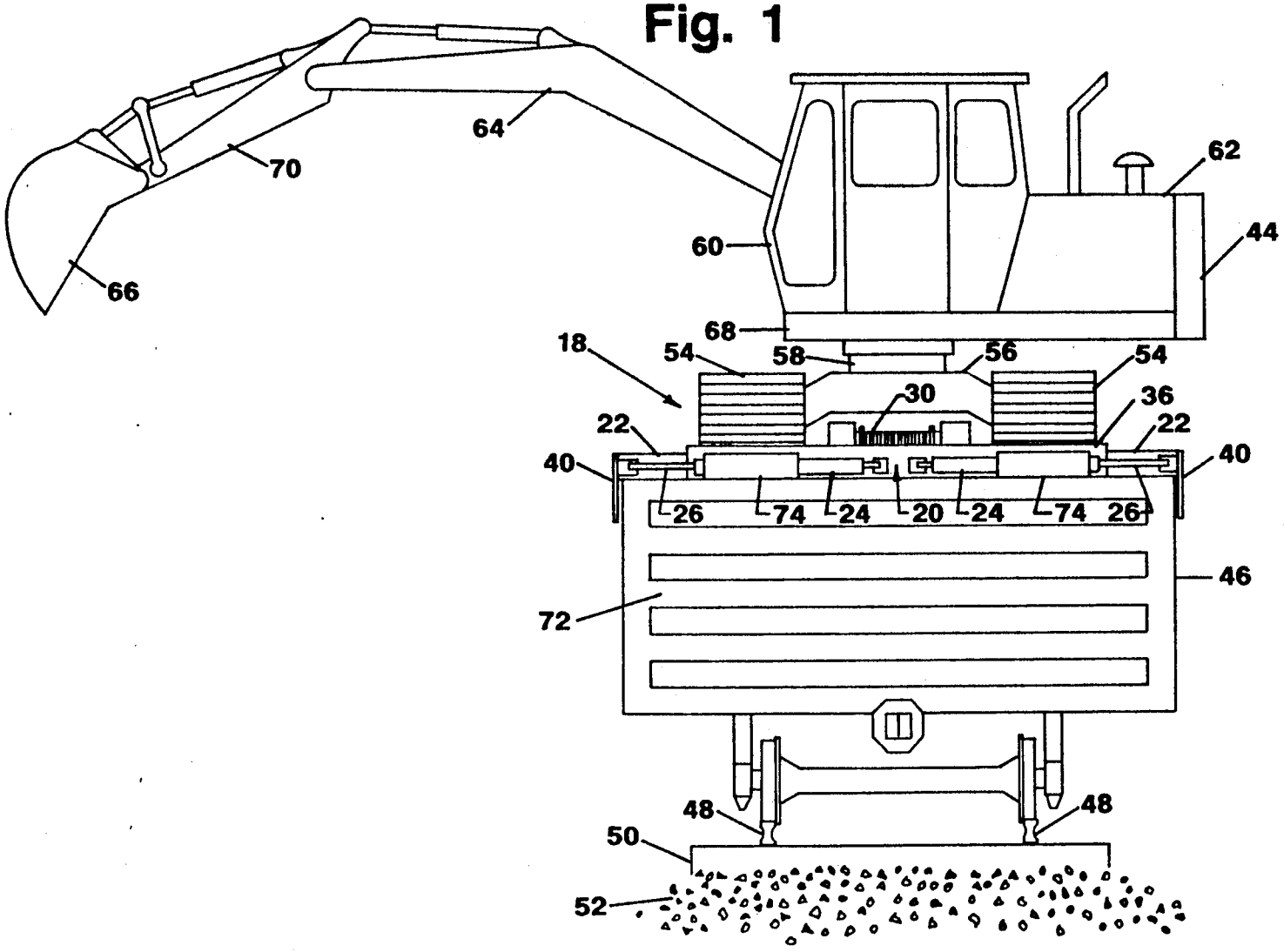
FIG. 1 is a rear elevational view of the apparatus on top of an open top railroad car.

| | |
|---|---|
| 18 | Apparatus (Slidable Structure with Hydraulic Excavator) |
| 20 | Slidable Structure |
| 22 | Support Member |
| 24 | Hydraulic Cylinder |
| 26 | Hydraulic Cylinder Piston |
| 30 | Hydraulic Winch |
| 32 | Winch Line |
| 34 | Winch Line Hook |
| 36 | Structure End |
| 38 | Attachment Pin |
| 40 | Stabilizer Dog |
| 42 | Structure Beam |
| 44 | Hydraulic Excavator |
| 46 | Open Top Railroad Car |
| 48 | Railroad Rail |
| 50 | Cross-tie |
| 52 | Railroad Bed |
| 54 | Excavator Track |
| 56 | Excavator Base |
| 58 | Turntable |
| 60 | Operator's Cab |
| 62 | Engine Housing |
| 64 | Boom Structure |
| 66 | Material Handling Device |
| 68 | Excavator Frame |
| 70 | Boom Arm |
| 72 | Railroad Car Endwall |
| 74 | Cylinder Cover |
| 76 | Railroad Car Sidewall |

Description—FIGS. 1 to 5

Referring now to the invention, the reference numeral 44 indicates generally one type of material handling equipment item used in the practice of this method of loading and unloading open top railroad cars. The material handling equipment item being commonly referred to as a hydraulic excavator which is of the type commonly used in construction and material handling operations.

Referring now to the drawings, the apparatus of the invention is referred to by numeral 18. In general, the apparatus is a slidable structure rigidly attached to a hydraulic excavator such as a John Deere Model 70-D available from Deere & Company of Des Moines, Iowa. However, the structure can also accept larger or smaller excavators, excavators with rubber tires, backhoe-loaders or excavators with the base mounted directly to the structure without tracks or wheels attached. The slidable structure is equipped with a winch for forward or backward movement in the direction of the railroad tracks.

In FIG. 1 the apparatus 18 is shown in position for loading and unloading railcars indicated by the numeral 46. The railcar 46 is located on the railroad rail 48 which is mounted on cross-tie 50 that rests upon the railroad bed 52. A hydraulic excavator 44 includes excavator track 54 for movement while working on the ground. Excavator track 54 is respectively connected to the excavator base 56 which supports the turntable 58.

The turntable 58 is rotatably connected to the excavator frame 68 which supports the engine housing 62, the operator's cab 60 and the boom structure 64. The boom structure 64 is equipped with a boom arm 70 which is attached to a material handling device 66 such as a bucket or scoop, a grapple, an electromagnet.

Figure 2:
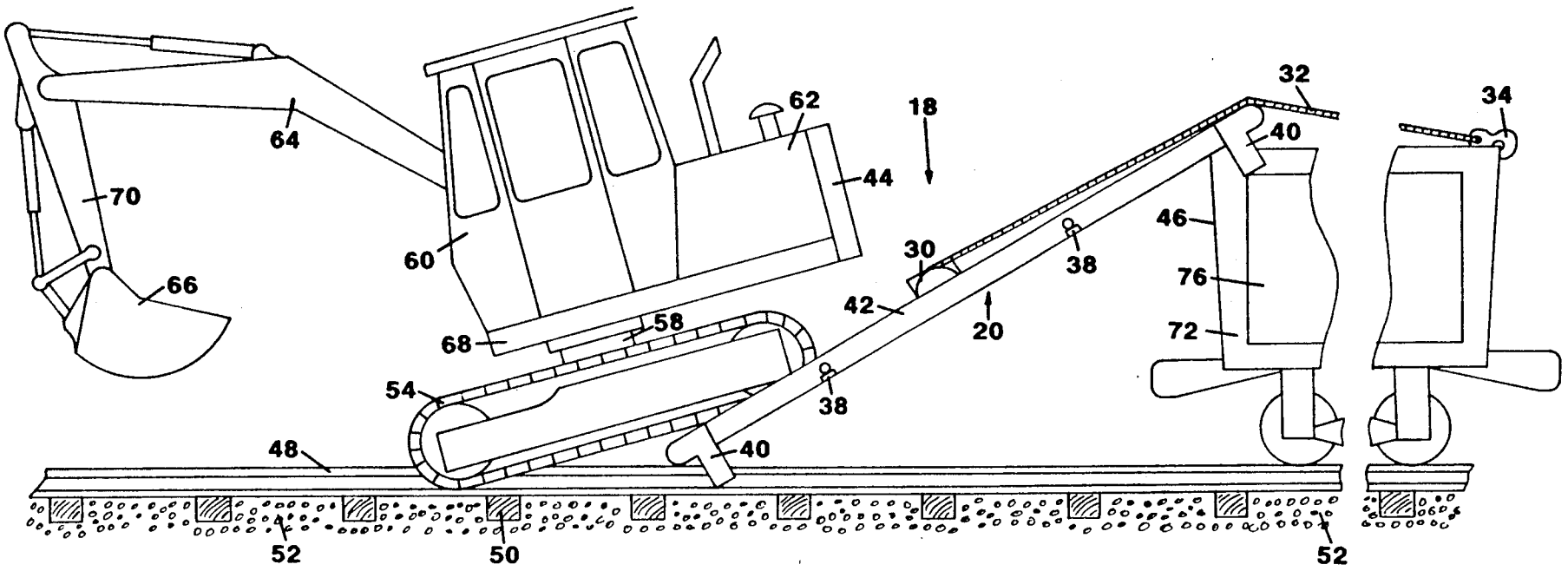
FIG. 2 is a side elevational view illustrating a material handling equipment item entering the slidable structure which has been positioned with one end engaged with the top surface of the railcar endwall and the other end resting upon the railroad bed.

In FIG. 2 the hydraulic excavator 44 is shown entering the slidable structure 20 for loading and unloading of the railcar 46. The front end of the slidable structure 20 is engaged with the top surface of the railcar endwall 72. The rear of the slidable structure 20 rests upon the railroad bed 52. With the slidable structure 20 in this position, the hydraulic excavator 44 is driven into its position upon the slidable structure 20. The hydraulic excavator 44 is then attached to the slidable structure 20 with attachment pins 38. The attachment pins 38 are inserted through holes in the structure beams 42 over the top of the lower section of the excavator tracks 54. A hydraulic winch 30 (mounted in the center of the slidable structure 20) is connected by hydraulic hoses (not shown) to the excavator's hydraulic system and controls (not shown) which are positioned inside the operator's cab 60. The winch line 32 with a winch line hook 34 is attached to the opposite end of railcar 46 from the apparatus 18. The material handling device 66 is then positioned on the railroad bed 52 adjacent to the rear of the slidable structure 20.

Figure 3:
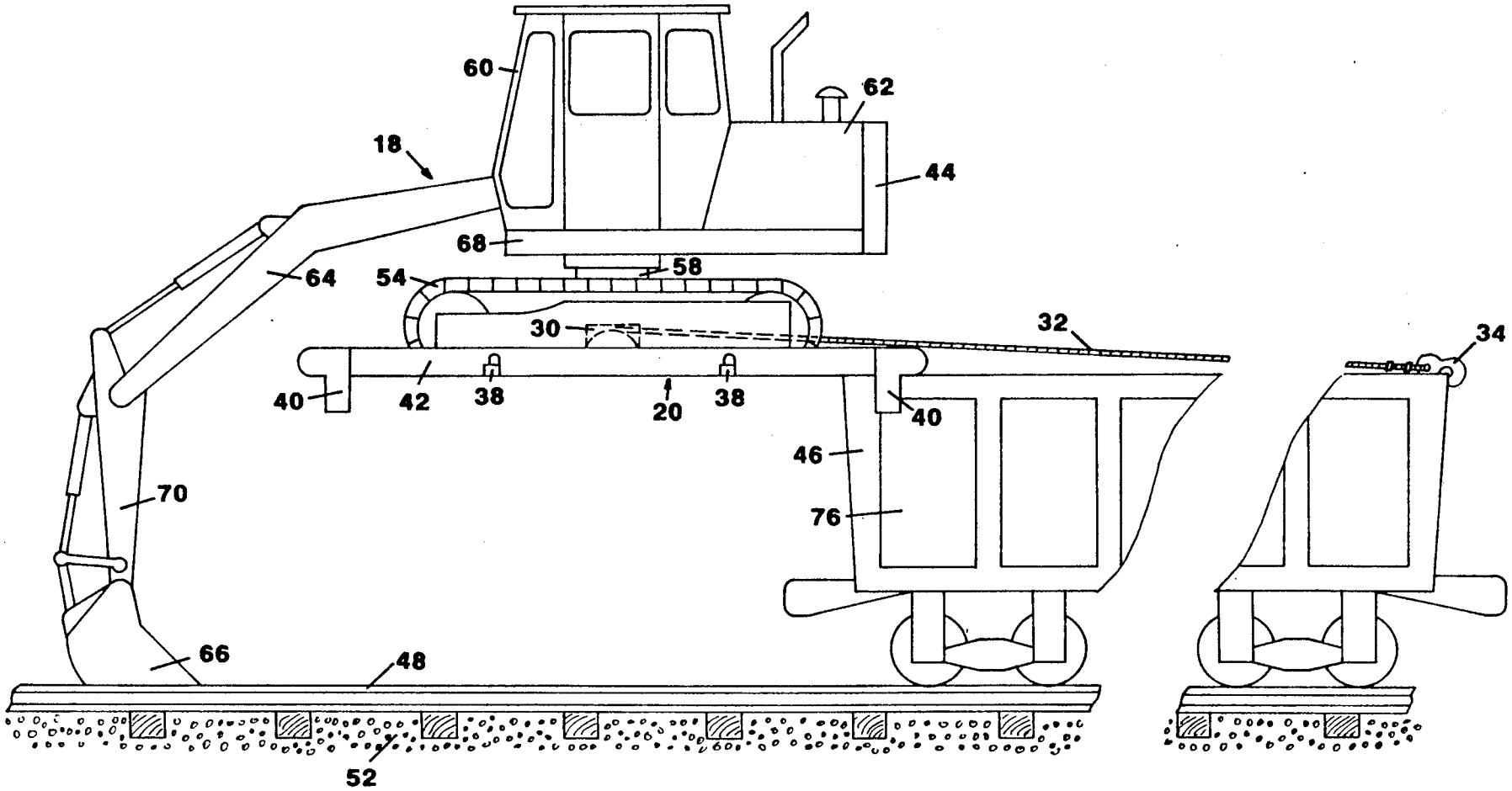
FIG. 3 is a side elevational view showing the apparatus being elevated, pushed and winched onto the top of the railcar.

In FIG. 3 the boom structure 64 is extended to elevate the apparatus 18. The hydraulic winch 30 is then engaged to propel the apparatus 18 forward while the boom structure 64 continues to extend to push the apparatus 18 atop the railcar 46. Connected to the outside of the slidable structure 20 are stabilizer dogs 40 which extend downwardly adjacent to the upper surface of the parallel railroad car sidewalls 76. The stabilizer dogs 40 prevent the apparatus 18 from slipping from the top of the railcar 46.

Figure 4:
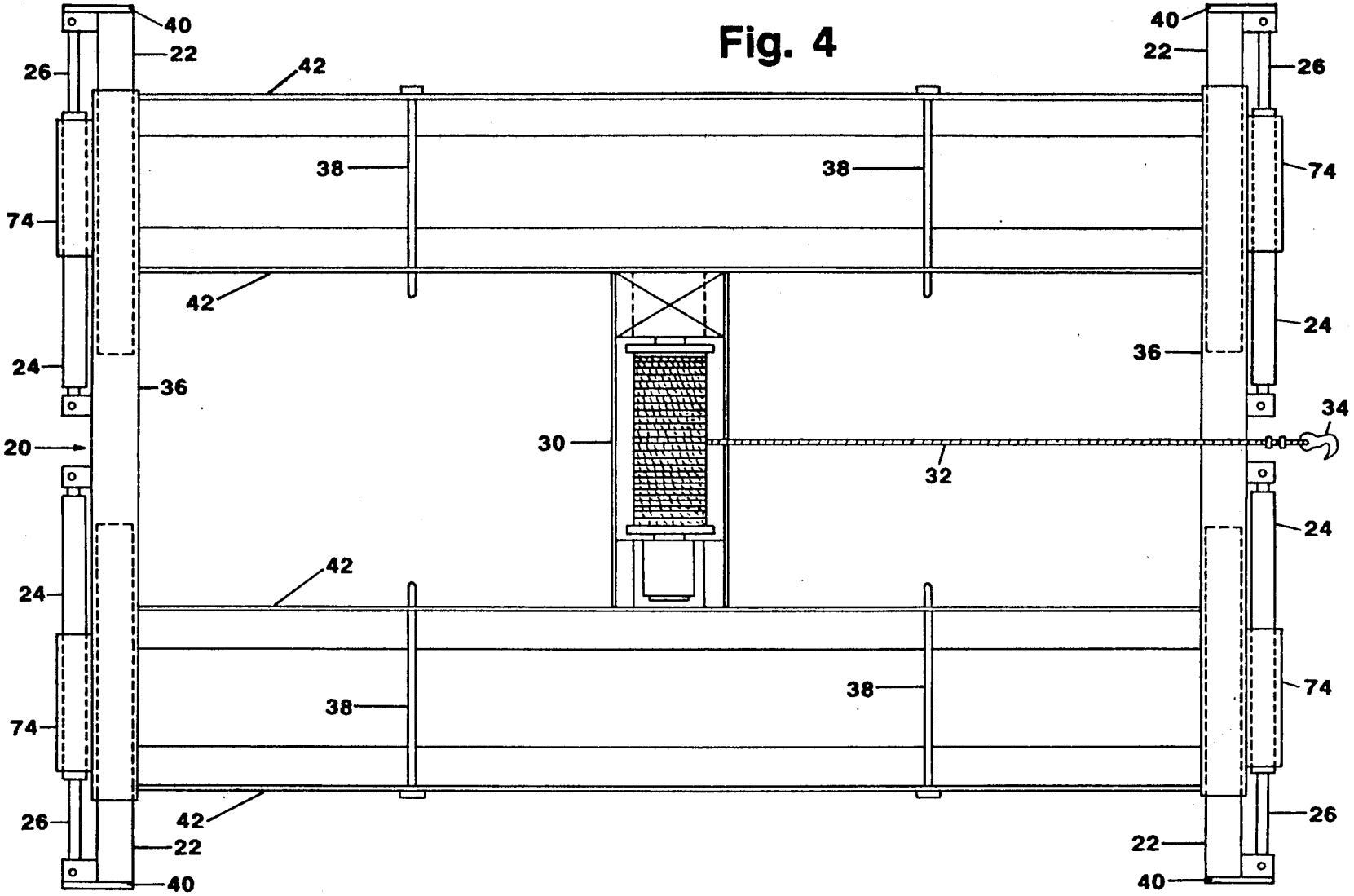
FIG. 4 is a top view of the slidable structure.
Figure 5:
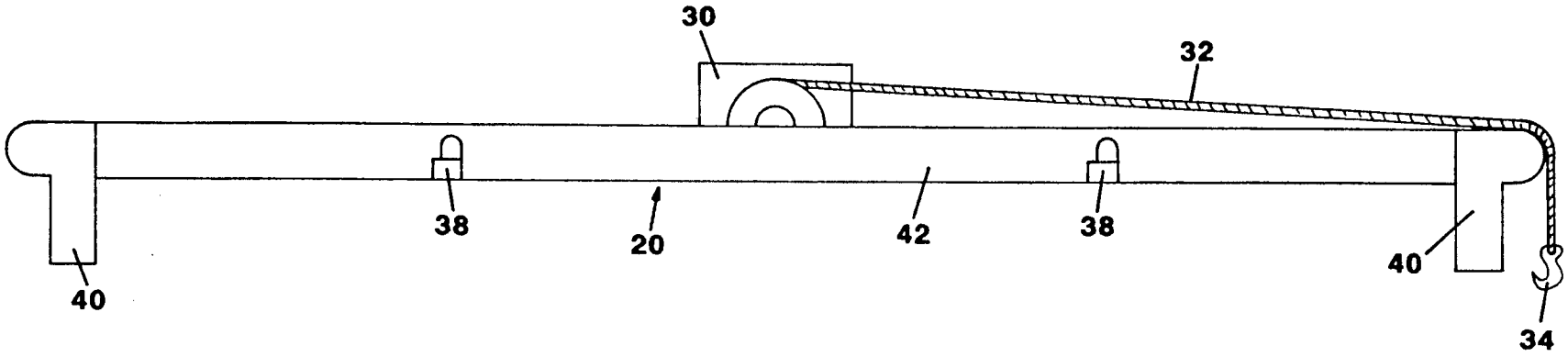
FIG. 5 is a side view of the slidable structure.

The slidable structure 20 shown in FIG. 4 and FIG. 5 includes front and rear structure ends 36 welded to a series of structure beams 42 constructed of angle iron. A series of attachment pins 38 are positioned through holes in the structure beams 42 to engage with excavator tracks 54 to secure the excavator 44 to the slidable structure 20. The winch line 32 with the winch line hook 34 can be attached to either end of railcar 46 for forward or backward movement of the apparatus 18. A series of support members 22 are slidably mounted inside the front and rear structure ends 36. A series of hydraulic cylinders 24 are connected by hydraulic hoses (not shown) to the excavator's hydraulic system and controls (not shown) which are positioned inside the operator's cab 60. The series of hydraulic cylinders 24 are connected to the structure ends 36. The hydraulic cylinder pistons 26 are attached to support members 22 to move them inwardly or outwardly from the slidable structure 20 as desired. With the apparatus in position for loading and unloading the railcar 46 as shown in FIG. 1 the hydraulic cylinder pistons 26 are retracted until stabilizer dogs 40 contact the outside surface of the railroad car sidewalls 76 to prevent lateral movement. The hydraulic cylinders 24 are protected by cylinder covers 74 when the hydraulic excavator 44 is entering or exiting the slidable structure 20 as shown in FIG. 2.

To remove the apparatus 18 from atop the railcar 46, the hydraulic winch 30 is engaged to propel the apparatus 18 to either end of the railcar 46. The operator of the apparatus 18 then reverses the above described entering procedure to remove the apparatus 18 from the railcar 46. First, the boom structure 64 is extended and the material handling device 66 is positioned on the railroad bed 52. The boom structure 64 is then retracted to pull and lower one end of the slidable structure 20 to the railroad bed 52. The attachment pins 38 are then removed. The hydraulic hoses (not shown) are disconnected from the winch 30 and the hydraulic cylinders 24. The excavator 44 is then driven off the slidable structure 20.

Summary, Ramifications and Scope

Thus the reader will see the apparatus of the invention is highly productive, versatile, economical and safe.

While my above description contains many specifications, these should not be construed as limitations on the scope of the embodiment thereof. Many other variations are possible. For example, the apparatus could include:

(a) larger or smaller hydraulic excavator
(b) hydraulic excavator with rubber tires
(c) backhoe-loader with rubber tires
(d) stationary type material handling equipment item without wheels or tracks.

Also, the material handling equipment item could be equipped with different material handling devices such as:

(a) bucket or scoop
(b) clam shell bucket
(c) hydraulic grapple
(d) electro-magnet
(e) cross-tie tong Accordingly, the scope of the invention should be determined not by the embodiments illustrated, but by the appended claims and their legal equivalents.

I claim:

1. An apparatus for loading and unloading an open top railroad car having spaced sides terminating in parallel sidewall upper surfaces, comprising:

(a) a support structure characterized by at least two structure beam members disposed in spaced, parallel relationship; at least two structure end members carried by each end of said structure beam members in spaced, transverse relationship; and stabilizing means mounted in adjustable relationship on said structure end members for engaging the sidewall upper surfaces of the sides of the open top railroad car and enabling said support structure to slide along the sidewall upper surfaces of the sides of the open top railroad car while loading and unloading the open top railroad car;

(b) a material handling equipment apparatus for loading and unloading the open top railroad car; attachment pin means provided in each of said structure beam members for removably securing the material handling equipment apparatus on said structure beam members, said material handling equipment apparatus having a boom structure with a material handling device; and (c) winch means mounted on said support structure to slidably move said support structure and said material handling equipment apparatus along the sidewall upper surfaces of the sides of the open top railroad car.

2. The apparatus of claim 1 wherein said winch means further comprises a winch drum rotatably carried by said structure beam members in transverse relationship, and a winch line wound on said winch drum, whereby said winch line projects between said structure beam members.

3. The apparatus of claim 1 wherein said stabilizing means further comprises a support member slidably carried by each end of said support structure in oppositely-disposed relationship and fluid cylinder means having one end secured to said support member and the opposite end of said fluid cylinder means secured to said support structure, respectively, whereby said support member is slidably adjustable with respect to said support structure for spanning the sidewall upper surfaces of the open top railroad car, responsive to operation of said fluid cylinder means.

4. An apparatus for supporting a material handling machine and loading and unloading an open top railroad car resting on rails supported by a rail bed, said apparatus comprising a support structure having at least two structure beam members disposed in spaced, parallel relationship; attachment pin means provided in each of said structure beam members for removably securing the material handling machine on said structure beam members; at least two structure end members carried by each end of said structure beam members in spaced, transverse relationship: and stabilizing means mounted in adjustable relationship on said structure end members for adjustably engaging the sidewall upper surfaces of the sides of the open top railroad car; winch means rotatably mounted in said support structure whereby one of said structure end members is rested against the open top railroad car with the opposite one of said structure end members engaging the railroad bed, the material handling machine is attached to said structure beam members, the material handling machine being operable relative to the railroad bed so as to elevate the said opposite one of said structure end members from its position engaging the railroad bed to a position where the support structure is generally parallel and level with the open top railroad car, and then said winch is operable to pull said support structure with said material handling machine thereon onto the sidewall upper surface of the sides of the open top railroad car.

5. The apparatus of claim 4 wherein said winch means further comprises a winch drum rotatably carried by said structure beam members in transverse relationship and a winch line wound on said winch drum, whereby said winch line projects between said structure beam members.

6. The apparatus of claim 4 wherein said stabilizing means further comprises a support member slidably carried by each of said structure end members and fluid cylinder means having one end secured to said support member and the opposite end of said fluid cylinder means secured to said structure end members, respectively, whereby said support member is slidably adjustable with respect to said structure end members, respectively, responsive to operation of said fluid cylinder means.

* * * * *